United States Patent [19]

Yasui et al.

[11] Patent Number: 4,805,650

[45] Date of Patent: Feb. 21, 1989

[54] APPARATUS FOR CLEANING A TANK-LIKE VESSEL

[75] Inventors: Hideo Yasui, Kobe; Toragoro Mitani; Takamichi Komabashiri, both of Takasago, all of Japan

[73] Assignee: Kanegafuchi Kagaku Kogyo Kabushiki Kaisha, Osaka, Japan

[21] Appl. No.: 46,366

[22] Filed: May 6, 1987

[30] Foreign Application Priority Data

May 10, 1986 [JP] Japan ..... 61-70472[U]

[51] Int. Cl.[4] ..... B08B 3/04; B66C 13/18

[52] U.S. Cl. ..... 134/57 R; 134/167 R; 134/168 R; 212/152; 212/100; 254/276; 254/411

[58] Field of Search ..... 134/167 R, 168 R, 57 R; 254/269, 276, 332–335, 336, 338, 411, 415; 212/151, 152, 187, 100–104

[56] References Cited

U.S. PATENT DOCUMENTS

| | | | |
|---|---|---|---|
| 879,744 | 2/1908 | Cooper | 212/104 |
| 1,345,881 | 7/1920 | Purnell et al. | 254/338 X |
| 1,624,865 | 4/1927 | Freel | 134/167 R |
| 1,877,171 | 9/1932 | Hallenbeck | 254/276 X |
| 3,094,221 | 6/1963 | Galuska | 212/151 |
| 3,292,904 | 12/1966 | Trubenback et al. | 254/334 X |
| 3,599,871 | 8/1971 | Ruppel et al. | 134/168 R X |
| 4,135,627 | 1/1979 | McInerney | 212/187 |
| 4,148,465 | 4/1979 | Bowman | 254/334 |
| 4,546,890 | 10/1985 | LeBars | 212/100 X |
| 4,560,074 | 12/1985 | Manning | 212/152 |

*Primary Examiner*—Harvey C. Hornsby
*Assistant Examiner*—Stephen F. Gerrity
*Attorney, Agent, or Firm*—Armstrong, Nikaido, Marmelstein & Kubovcik

[57] ABSTRACT

An apparatus for cleaning a tank-like vessel comprising (a) a supporting arm attached to a fixing plate, which can perpendicularly extend downward, (b) a folding arm of which base portion is rotatably attached to the lower end of the supporting arm, a position of the folding arm being changeable between a housed position and a position in use wherein the folding arm is approximately horizontally stretched out, (c) a rope winded up and winded down by a hoist, and (d) a cleaning nozzle capable of injecting jet water in a two-dimensional direction or three-dimensional direction.

9 Claims, 5 Drawing Sheets

APPARATUS FOR CLEANING A TANK-LIKE VESSEL

BACKGROUND OF THE INVENTION

The present invention relates to an apparatus for cleaning a tank-like vessel and more particularly to an apparatus for cleaning the inside of a tank-like vessel such as a reactor, a storage tank, a dissolver, and a scrubber.

Hitherto, there have been known, as apparatuses for cleaning tank-like vessels, a jet gun system using a jet gun which blows a high-pressure water in one direction, and a lance system using a multi-dimensional nozzle capable of blowing a high-pressure water in a two-dimensional direction or a three-dimensional direction.

The above-mentioned jet gun system is such a system wherein a worker with a jet gun directs the gun against a portion to be cleaned. The jet gun system is often used in the case of low-pressure cleaning or under good working conditions thanks to its simplicity.

The above-mentioned lance system includes a fixed lance system using a lance of which length is fixed, and an expansion lance system using an expansible lance. These two systems, i.e. a fixed lance system and an expansion lance system, are suitable for automatic cleaning because of the use of multi-dimensional nozzles.

However, the above-mentioned jet gun system has the following drawbacks.

(1) Because of the manual operation, the reaction of jet water is enlarged when heightening the pressure of supply water. Therefore, a strong power is required to support a jet gun.

(2) If a portion to be cleaned is distant from a worker, a gun is required to be connected to a lance in order to approach the portion to be cleaned. In that case, the operation of the gun becomes considerably hard because of the difficulty in supporting a weight of the gun and lance. It is therefore, impossible to work for a long period of time with the gun.

(3) When cleaning the inside of a vessel from the outside, cleanable area is limited to the vicinity of an upper opening of a vessel.

(4) There is inevitably made dead space because the lance system uses a straight water jet. Accordingly, many portions are likely to be left uncleaned.

(5) When a worker operates a jet gun in a vessel, a perfect cleaning is actually very difficult, because a scaffold is difficult to certainly set up and it is difficult to make sure portions to be cleaned due to the poor visibility by floating water droplets.

On the other hand, the above-mentioned lance system has the following drawbacks.

(1) A lance is required to have a strong construction because the lance is subjected to the reaction of jet water. The weight of the lance becomes large, and accordingly the size of the whole equipment supporting the lance becomes large and the weight thereof also becomes large.

(2) Because of a large size and weight of the equipment, there are required a large-scale conveyor such as a truck and a large working space, which raises a cost of the equipment.

(3) The most serious disadvantage of the lance system is that, both in the case of a fixed lance system and an expansion lance system, the insertion direction of a cleaning nozzle is limited to a direction straight from a portion whereinto the lance is inserted because the lance has such a construction that it is straightly extended in one direction. There is generated, therefore, dead space when a portion to be cleaned is far away from a portion whereinto the lance is inserted or the vessel has a touch of complicated construction, whereby the perfect cleaning cannot be expected.

(4) The cleanable area is limited to the upper portion of the vessel, i.e. the vicinity of the opening in the case of a fixed lance system. Further, even in the case of an expansion lance system, the perfect cleaning cannot be expected with respect to a large-scale vessel due to the limitation in the length of a lance.

Besides above-mentioned drawbacks, both in the case of a fixed lance system and an expansion lance system, the cleaning power is remarkably weakened due to the reduction of impact power of jet water when a portion to be cleaned is far away from a cleaning nozzle.

An object of the present invention is to provide an apparatus which is easy to handle and enables the perfect cleaning of the inner surface of a tank-like vessel.

SUMMARY OF THE INVENTION

In accordance with the present invention, there is provided an apparatus for cleaning a tank-like vessel comprising (a) a supporting arm attached to a fixing plate in such a manner that the supporting arm can perpendicularly extend downward, the fixing plate being fixable to an upper opening of a tank-like vessel to be cleaned, (b) a folding arm of which base portion is rotatably attached to the lower end of the supporting arm, a position of the folding arm being changeable between a housed position wherein the folding arm is folded along the supporting arm and a position in use wherein the folding arm is approximately horizontally stretched out from the lower end of the supporting arm, (c) a rope passing a guide sheave provided at a head of the folding arm, and is winded up and winded down by a hoist attached to the fixing plate, and (d) a cleaning nozzle suspended from the lower end of the rope and being capable of injecting jet water in a two-dimensional direction three-dimensional direction.

According to the present invention, because a cleaning nozzle suspended from a head of the folding arm can approach an inner surface of a vessel by horizontally stretching the folding arm, a distance between the cleaning nozzle and a portion to be cleaned is shortened. The cleaning performance is remarkably promoted because the inner surface is cleaned under a high water pressure.

The cleanable area is not limited to the vicinity of the upper end of a vessel and can be extended to the extent of a lower portion of the vessel because the cleaning nozzle is suspended by a rope and the rope is winded down to bring down the cleaning nozzle to the lower end of the vessel.

Further, the cleaning nozzle uses a multi-dimensional nozzle capable of injecting jet water in a two-dimensional direction or three-dimensional direction. Therefore, there is not generated any dead space due to agitators or baffle-plates, and uncleanable portions do not exist. The whole inner surface of the vessel can be perfectly cleaned.

The folding arm can be easily inserted into a vessel from an upper opening of the vessel and removed therefrom since the folding arm can be folded along the supporting arm. So, the apparatus of the present invention is very easy to handle.

DETAILED DESCRIPTION

There is now explained an embodiment of an apparatus of the present invention.

Figure 1:
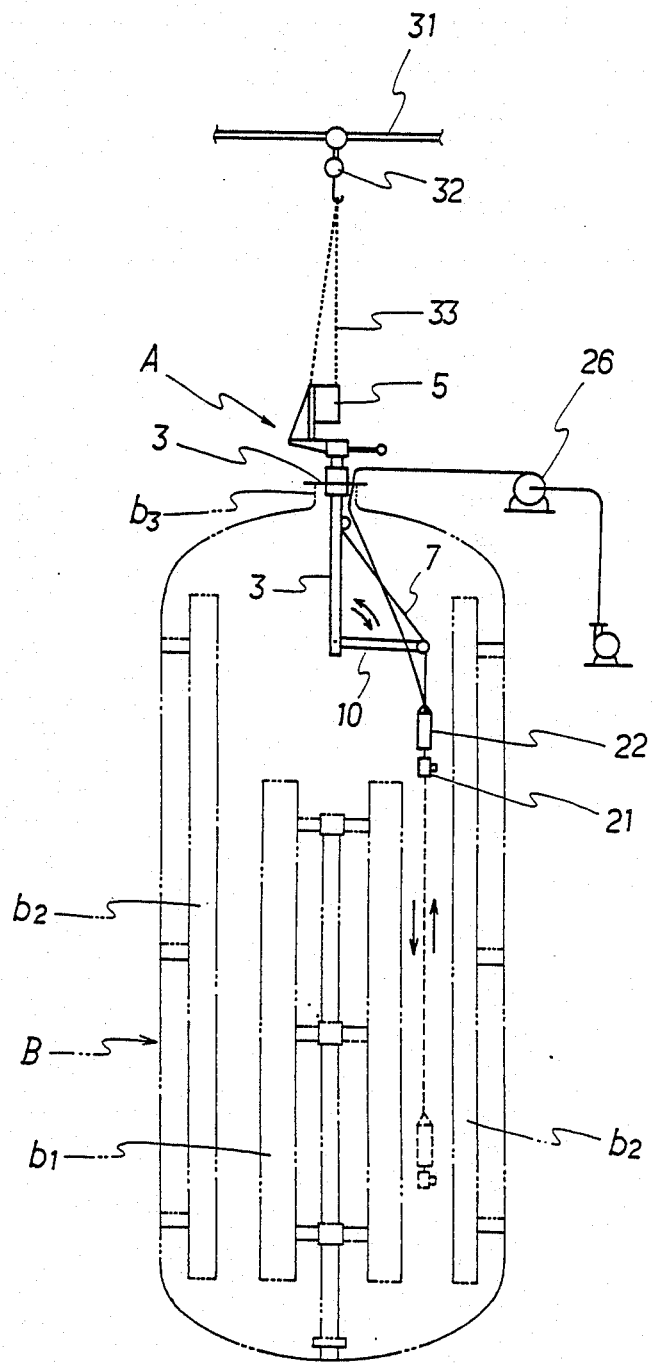
FIG. 1 is a view explaining a state wherein an enbodiment of an apparatus of the present invention is in use.

In FIG. 1, symbol A is a cleaning apparatus and symbol B is a reactor to be cleaned. Vessels to be cleaned include various kinds of tank-like vessels besides a reactor. In the present specification, the explanation is made using the reactor B as an object to be cleaned. The reactor B is a cylindrical tank-like vessel which is installed longitudinally as shown in FIG. 1. In the reactor, there are provided agitator $b_1$ and baffle-plates $b_2$. To a flange $b_3$ at an upper end opening of the reactor B, a cleaning apparatus A of the present invention is attached.

Figure 2:
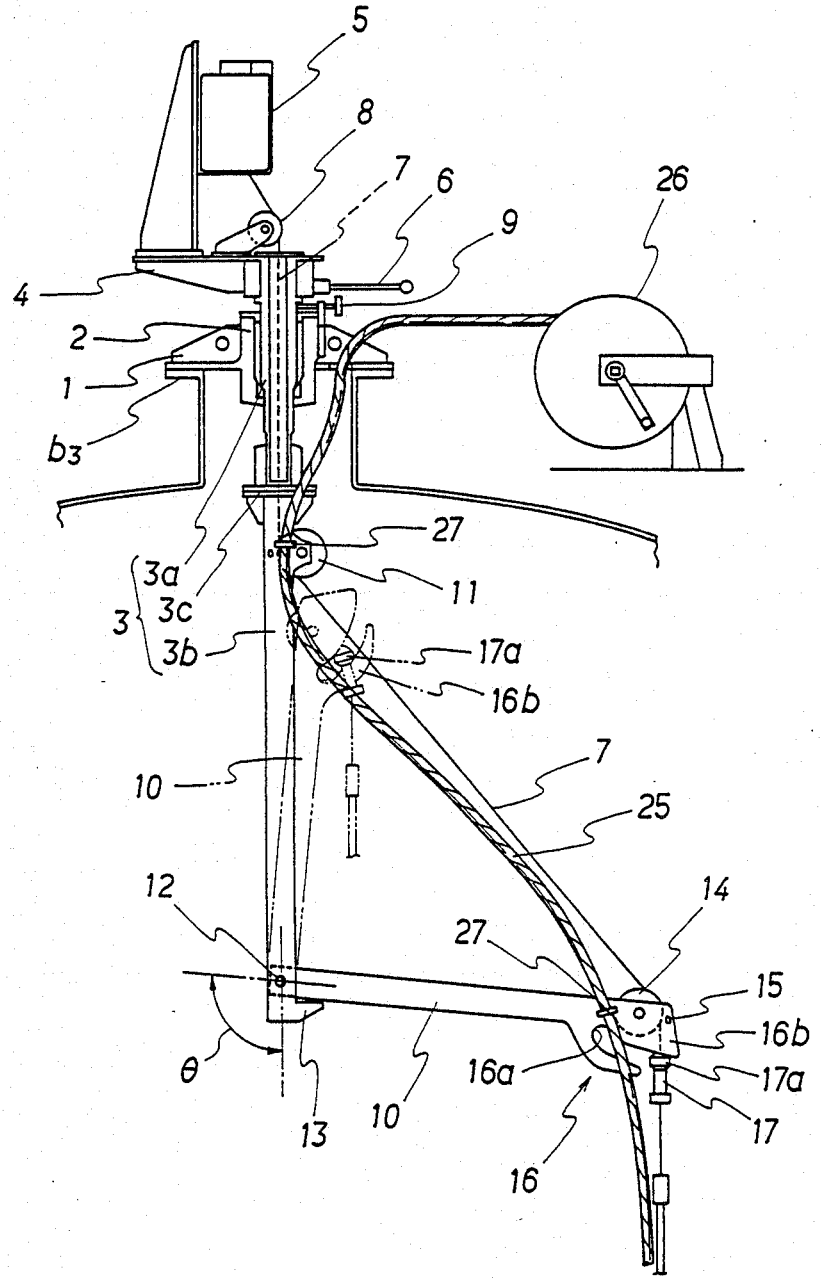
FIG. 2 is a view explaining an upper construction of the apparatus shown in FIG. 1.
Figure 3:
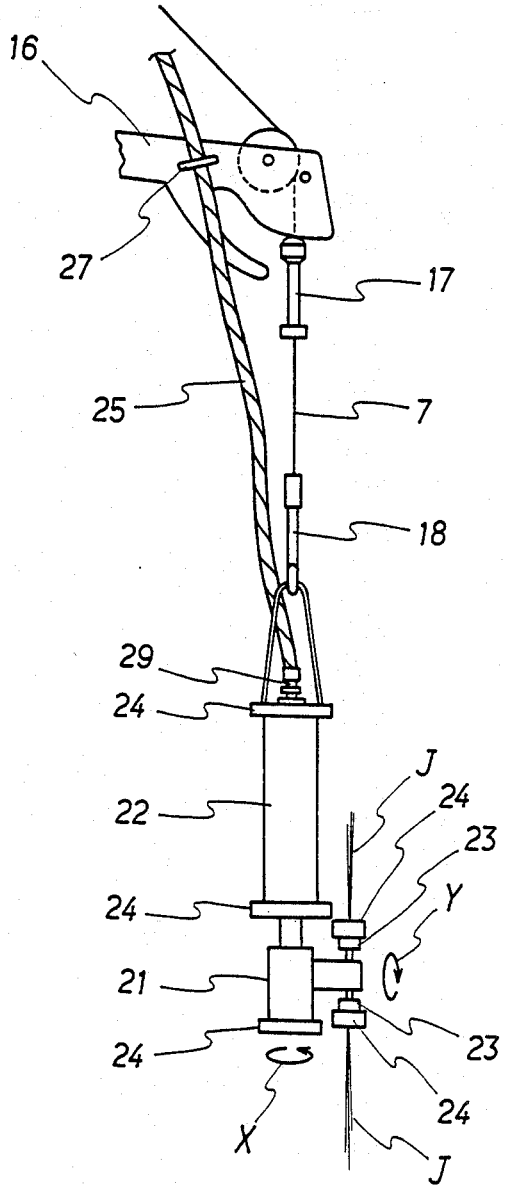
FIG. 3 is a view explaining a lower construction of the apparatus shown in FIG. 1.

Next, the details of the cleaning apparatus A are explained based on the accompanying FIGS. 2 and 3.

A fixing plate 1 is a base member of the cleaning apparatus A and is fixed to a flange $b_3$ of an upper end opening of a reactor B by means of a suitable fixing means. The fixing plate 1 can be, of course, attached to and detached from the flange $b_3$. A bearing 2 is provided at the center of the flange $b_3$. An upper column 3*a* is rotatably inserted into the inside of the bearing 2. A lower column 3*b* is connected to the lower portion of the uppe column 3*a* through a flange 3*c*. A supporting arm 3 is composed of the upper column 3*a* and the lower column 3*b*. At the upper end of the upper column 3*a*, there is provided a base 4 whereon an electrically operated hoist 5 for winding up and winding down a rope 7 is fixed. To the base 4, there is attached a handle 6 for rotating the supporting arm 3 by worker's manual operation. It is preferable that a direction of the handle 6 is substantially equal to that of a folding arm 10 mentioned later. The upper column 3*a* is hollow and through which the rope 7 is passed. Numeral 8 is a guide sheave provided on the base 4, and numeral 9 is a screw-type fixing means for fixing the upper column 3*a*. The fixing means 9 is provided between the fixing plate 1 and the upper column 3*a*.

The supporting arm 3 and the folding arm 10 are explained hereinafter referring to FIG. 4 together with FIGS. 1 to 3.

The lower column 3*b* is a U-shaped column-like member composed of two sheet-like members connected to each other. A guide sheave 11 for guiding a rope 7 is provided at an upper portion of the lower column 3*b*. A little below the guide sheave 11, there is attached a limit switch 19 mentioned later used in an automatic stop mechanism. A flucrum pin 12 and a stopper 13 are attached to the lower end of the lower column 3*b*. One end of the folding arm 10 is rotatably supported by means of the flucrum pin 12. The folding arm 10 is designed to be a little shorter than the lower column 3*b*. Thus, the folding arm 10 can be folded along the supporting arm 3 to take a housed position (shown in FIG. 2 in alternate long and two short dashes line), and can be approximately horizontally stretched to take a position in use. When the folding arm 10 is folded, the limit switch 19 is pressed by the folding arm 10 and operated. The position in use, wherein the folding arm 10 is approximately horizontally stretched, is held by the stopper 13.

An angle $\theta$ (shown in FIG. 2) between the supporting arm 3 and the folding arm 10 held by the stopper 13 is preferably a little larger than 90°, so that there is avoided a closing movement of the folding arm 10 by mere chance.

The folding arm 10 is composed of two sheet-like members connected to each other. A guide sheave 14 for guiding a rope 7 is attached to the head of the folding arm 10. Metal fitting 15 for preventing the detachment of the rope is provided at the guide sheave 14 and the guide sheave 11 on the lower column 3*b*.

An engaging portion 16 is formed at the under surface of the head of the folding arm 10. The engaging portion 16 has a curved notch 16*a*. A catching member 17 fixed to the rope 7 is put and held between an upper projection 16*b* and a lower projection 16*c*. The catching member 17 is a bar-like member of which section is about I-shape, and has a bulge portion 17*a* at the upper end thereof. The rope 7 passes through the catching member 17. When the bulge portion 17*a* of the catching member 17 is engaged with the notch 16*a*, the catching member 17 is held by the engaging portion. The catching member 17 is designed to engage with the notch 16*a* when the angle $\theta$ between the folding arm 10 and the supporting arm is smaller than a balancing angle (about 63°), and to disengage from the notch 16*a* when the angle $\theta$ is equal or larger than the balancing angle. The term "balancing angle" means such an angle that the movement of the folding arm 10 toward a housed position and that toward a position in use is well-balanced. In the present embodiment, the "balancing angle" is about 63°.

As shown in FIG. 3, a hook 18 is attached to the lower end of the rope 7. A cleaning nozzle and a weight 22 are suspended from the hook 18. The cleaning nozzle 21 employs a multi-dimensional nozzle capable of injecting jet water in a two-dimensional direction or three-dimensional direction. The cleaning nozzle 21 in the present embodiment can revolve (in a direction X of FIG. 3) and rotate (in a direction Y of FIG. 3). The cleaning nozzle 21 has two nozzles symmetrically arranged and therefrom jet water J is injected in two directions opposite each other. In this kind of non-reaction-type cleaning nozzle wherein jet water J is injected in two directions opposite each other, there is generated little swing of the cleaning nozzle 21 if the nozzle 21 is used in a suspended condition, because the reactions of jet water J cancel each other. Jet water J might be injected horizontally besides vertically. A cleaning nozzle in the present invention is not limited to those described above, and various kinds of cleaning nozzles can be employed in the present invention. The cleaning nozzle 21 preferably has a protector 24 to protect a body and nozzles thereof.

The weight 22 is employed in the present embodiment in order to prevent the swinging as much as possible which is generated when the cleaning nozzle 21 in a suspended condition injects jet water, and gives an operation power for stretching the folding arm 10. The "weight" of the weight 22 is suitably determined to accomplish the above purposes. It is preferable that the cleaning nozzle 21 is attached beneath the weight 22 and the weight 22 is directly suspended from the hook 18, because in that case the weight of the weight 22 does not act on the cleaning nozzle 21. It is preferable that a strainer (not shown) is attached to the cleaning nozzle 21. according to the necessity. If the weight 22 is provided with a protector 24, the internal structures of the reactor B are not damaged even when the weight 22 contacts with them by the abnormal change of supply water pressure.

In FIGS. 2 to 3, numeral 25 is a hose for supplying a high-pressure water to the cleaning nozzle 21. One end of the hose 25 is winded round a hose reel 26 installed at a suitable place, and the other end of the hose 25 is connected to a connection 29 of the weight 22. High-pressure water is supplied to the cleaning nozzle 21 through an internal passage (not shown) of the weight 22. Hose guides are provided at suitable portions of the supporting arm 3 and the folding arm 10 to guide the hose 25. The hose 25 passes through the hose guides. The hose reel 26 preferably has a tension-adding mechanism to slightly stretch the hose 25 in a winding direction. A supply source of high-pressure water such as a pump is connected to the hose reel 26.

The rope 7 is fed and the cleaning nozzle 21 goes down by the winding-down operation of the electrically heated hoist 5, and contrariwise the rope 7 is winded up and the cleaning nozzle 21 goes up by the winding-up operation of the hoist 5. The up-and-down stroke of the cleaning nozzle 21 is freely set up depending on the length of the rope 7. When the electrically operated hoist 5 is operated, as shown in FIG. 2, to wind up the rope 7 while the catching member 17 contacts with the engaging portion 16, the bulge portion **17*a* of the catching member 17 is engaged with the notch 16*c* of the engaging portion 16 and the head of the folding arm 10 is raised, whereby the folding arm 10 is folded from a position in use shown in a continuous line to a housed position shown in an alternate long and two short dashes line. On the other hand, when the electrically operated hoist 5 is operated to wind down the rope 7 from the above condition (wherein the folding arm 10 is in a housed position), the rope 7 goes down by the weight of the weight 22. Then, the folding arm 10 is rotated downward while the bulge portion 17*a* of the catching member 17 is engaged with the lower projection 16*b* of the engaging portion, and the position of the folding arm 10 is changed from a housed position to a position in use wherein the folding arm 10 is approximately horizontally stretched. Thus, the folding arm 10 is automatically folded or stretched by the winding-up or winding-down operation of the hoist 5**.

When the folding arm 10 is horizontally stretched in such a manner as described above, the cleaning nozzle 21 can approach the inner surface of the reactor B. Further, the supporting arm 3 is rotated within the bearing 2 by the manual rotating operation of a handle 6 by a workman, and whereby the cleaning nozzle 21 can be freely rotated. If the rotation of the cleaning nozzle 21 is not required, the supporting arm 3 is preferably fixed by means of a fixing means 9 so as not to move, which facilitates the operation when the same portion is cleaned. When the attachment direction of the handle 6 is substantially equal to that of the folding arm 10, the circumferential position of the cleaning nozzle can be conveniently judged by the direction of the handle 6 without observing the inside of the reactor B.

The electrically operated hoist 5 preferably has an automatic stop mechanism for stopping the rotation of the hoist 5 when the winding-up or winding-down of the rope 7 comes up to the limit. An employable automatic stop mechanism includes, for instance, a revolution counter which adds the number of revolutions of the hoist 5 in a winding-down direction and substracts the same in a winding-up direction, and the above-mentioned limit switch located on the lower column **3*b*. The automatic stop mechanism might have such a construction that, when setting a winding-down limitation value, the number of revolutions corresponding to the winding-down limitation value is entered into a comparator, and an actual number of revolutions is detected by the revolution counter and entered into the comparator, so as to operate a winding-down stop switch when the actual number of revolutions comes up to the limitation vlaue. On the other hand, the limitation of the winding-up of the rope can be detected by the fact that the folding arm 10 is folded along the supporting arm 3 using the above-mentioned limit switch 19**. By the detection signal, a winding-up stop watch might be operated. It is preferable that the revolution counter is reset to zero whenever the detection signal of the limit switch is entered into the automatic stop mechanism.

When using the above-mentioned revolution counter, the vertical position of the cleaning nozzle 21 in the reactor B can be displayed by the conversion of displayed number of revolutions. When the vertical position of the cleaning nozzle 21 can be displayed in such a manner as described above, there becomes possible a multipoint automatic cleaning including a cleaning time by indicating the readial direction of the folding arm 10 with the rotation angle.

Figure 4:
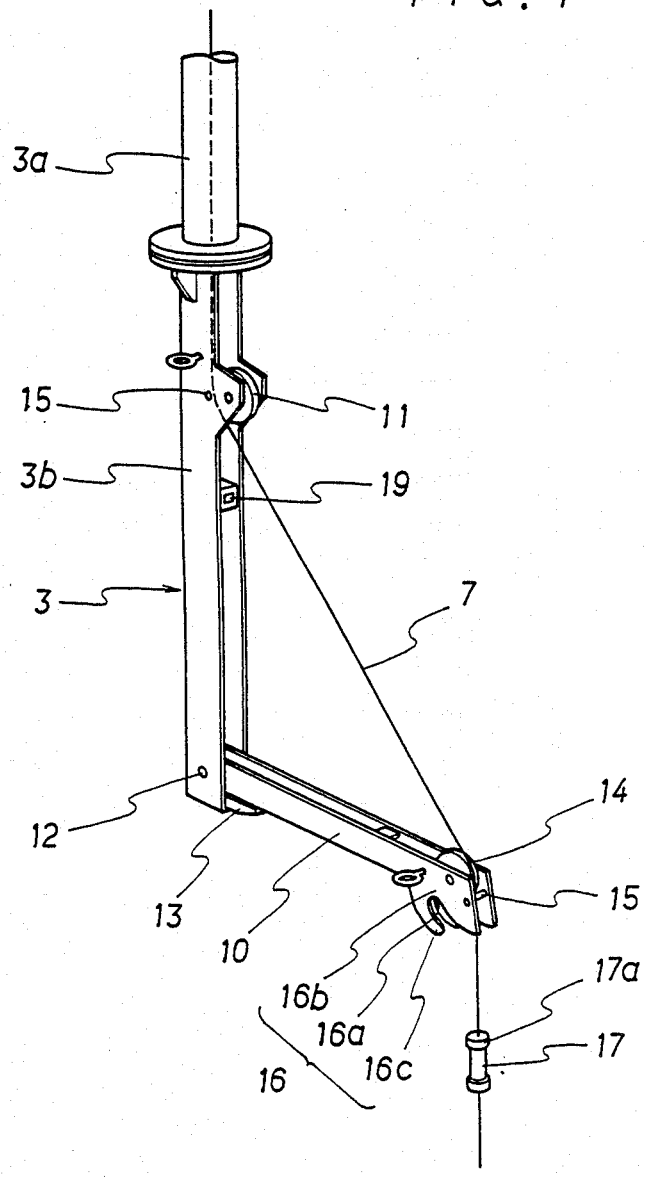
FIG. 4 is a perspective view of a supporting arm and a folding arm.

Next, there is explained the function of the cleaning apparatus A referring to FIG. 1 together with FIGS. 2 to 4.

In FIG. 1, numeral 31 is a rail installed at a high place in a factory such as a vicinity of a ceiling, and numerals 32 and 33 are a travelling hoist and a suspension chain respectively. After being suspended by the travelling hoist 32 and moved to a position above the reactor B, the cleaning apparatus A is inserted into the reactor through the upper end opening thereof by the winding-down operation of the above-mentioned hoist 32. In that case, the cleaning apparatus A can be easily inserted into the vessel even through a very narrow opening, because the folding arm 10 is folded along the supporting arm 3. After the insertion of the cleaning apparatus A, the fixing plate 1 is fixed to the flange $b_3$.

By the winding-down operation of the electrically operated hoist 5, the rope 7 is fed. Then, the folding arm 10 is blown down by the weight 22 under the condition wherein the catching member 17 is engaged with the engaging portion 16, and is automatically stretched in an approximately horizontal direction. Thus, the cleaning nozzle 21 at the lower end of the rope 7 approaches the inner wall of the reactor B. With a supply of high-pressure water to the cleaning nozzle 21, jet water J is injected from the cleaning nozzle 21 to clean the inner wall of the reactor B. By suitably combining the revolution movement (in a X direction) and the rotation movement (in a Y direction), jet water J can be injected in a multi-direction and whereby all the corners of the reactor B is cleaned in spite of the existence of agitator $b_1$ and baffle-plates $b_2$. The cleaning nozzle 21 can be gone down to the bottom portion of the reactor B by the winding-down operation of the electrically operated hoist 5, and therefore the whole inner wall of the reactor can be cleaned. In the present embodiment, every part of the inner wall of the reactor B can be cleaned with a strong cleaning performance because the cleaning nozzle 21 can approach the inner wall and freely move in a three-dimensional direction.

The cleaning nozzle 21 is stable without seriously swinging when injecting jet water J, since the weight 22 is attached to the cleaning nozzle 21 suspended by a rope. Therefore, the position of the cleaning nozzle 21 in the reactor B can be freely controlled and the aimed portion of the inner surface can be exactly cleaned.

After the cleaning work, the cleaning nozzle 21 is gone up by the winding-up operation of the electrically operated hoist 5. With the winding-up of the rope, the folding arm 10 is raised up by the engagement of the catching member 17 with the engaging portion 16, and then the folding arm 10 is folded along the supporting arm 3 to be in a housed position. The cleaning apparatus A can be drawn out from the reactor B by releasing the fixation of the fixing plate 1 to the flange $b_3$ of the reactor B and by operating the travelling hoist 32 to wind up the rope.

Figure 5:
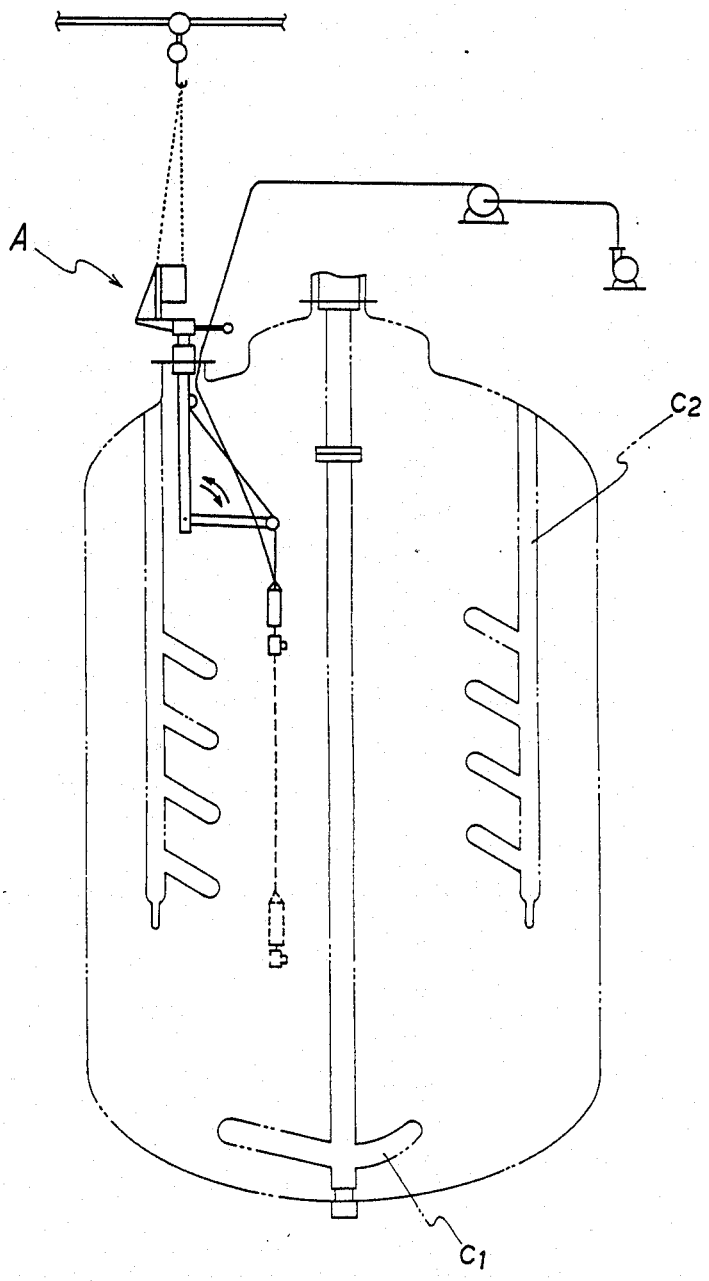
FIG. 5 depicts another embodiment of an apparatus of the present invention, wherein an agitator drive device is mounted at the top of a vessel.

FIG. 5 depicts another embodiment of the apparatus of the present invention. In FIG. 5, an agitator drive device (not shown) is mounted at the top of a vessel. $C_1$ and $C_2$ are a phaudler impeller and a finger baffle installed in a vessel, respectively. A cleaning apparatus A is inserted through an opening located a little away from the top of the vessel.

According to the present invention, there can be obtained various kinds of practical effects that (1) a strong cleaning performance can be obtained, (2) both the lower portion and the upper portion of the vessel are cleanable, (3) the whole inner wall of the vessel is cleanable without generating a dead space, and (4) the apparatus can be easily inserted into and drawn out from the vessel.

It is further understood by those skilled in the art that the foregoing description is a preferred embodiment of the disclosed apparatus and that various changes and modifications might be made in the invention without departing from the spirit and scope thereof.

What we claim is:

1. An apparatus for cleaning a tank-like vessel comprising (a) a supporting arm attached to a fixing plate in such a manner that the supporting arm can perpendicularly extend downward, the fixing plate being fixable to an upper opening of a tank-like vessel to be cleaned, (b) a folding arm of which base portion is rotatably attached to the lower end of the supporting arm, a position of the folding arm being changeable between a housed position wherein the folding arm is folded along the supporting arm and a position in use wherein the folding arm is approximately horizontally stretched out from the lower end of the supporting arm, the improvement wherein (c) a rope passes over a guide sheave provided at the head of a folding arm, and is winded up and winded down by a hoist attached to the fixing plate for moving said folding arm into said housed position and said horizontal position, and a cleaning nozzle is fixed directly to the lower end of the rope, is moved up and down in said tank-like vessel when said arm is in said horizontal position and said end of said rope is moved up and down as said rope is wound on said sheave and is capable of injecting water in a multi-dimensional direction.

2. The apparatus of claim 1, wherein the cleaning nozzle and a weight are integrally attached to the lower end of the rope.

3. The apparatus of claim 2, wherein a catching member is provided near the lower end of the rope and an engaging portion with which the catching member can be engaged is formed at a head of the folding arm, the catching member being engaged with the engaging portion when winding up the rope so as to change a position of the folding arm from a position in use to a housed position and when winding down the rope so as to change a position of the folding arm from a housed position to a position in use.

4. The apparatus of claim 2, wherein each of the cleaning nozzle and the weight have a protector.

5. The apparatus of claim 1, wherein a metal fitting for preventing the detachment of the rope is provided at the guide sheave attached to a head of the folding arm.

6. The apparatus of claim 1, wherein the hoist has an automatic stop mechanism to stop the rotation of the hoist when the rope is winded down to a predetermined limitation value of the winding-down of the rope.

7. The apparatus of claim 1, wherein the hoist has an automatic stop mechanism to stop the rotation of the hoist when the folding arm is completely folded along the supporting arm.

8. The apparatus of claim 1, wherein a handle for rotating the supporting arm is provided at about an upper end of the supporting arm, in such a manner that an attachment direction of the handle is substantially equal to a direction of the cleaning nozzle in a horizontal plane.

9. The apparatus of claim 1, wherein a position of the cleaning nozzle in a vertical direction is displayed on the basis of the number of revolutions of said hoist.

* * * * *